US007020994B2

(12) United States Patent
Buie, II

(10) Patent No.: US 7,020,994 B2
(45) Date of Patent: Apr. 4, 2006

(54) GUN CLEANING KIT

(75) Inventor: James H. Buie, II, Little Rock, AR (US)

(73) Assignee: Dac Technologies Group Int'l., Inc., Miami Beach, FL (US)

( * ) Notice: Subject to any disclaimer, the term of this patent is extended or adjusted under 35 U.S.C. 154(b) by 55 days.

(21) Appl. No.: 10/871,627

(22) Filed: Jun. 18, 2004

(65) Prior Publication Data

US 2006/0010753 A1 Jan. 19, 2006

(51) Int. Cl.
*F41A 29/02* (2006.01)

(52) U.S. Cl. ..... 42/95; 15/104.53; 15/104.2

(58) Field of Classification Search ..... 42/95; 15/104.52, 104.53, 104.54, 104.165, 104.2, 15/104.9, 104.5

See application file for complete search history.

(56) References Cited

U.S. PATENT DOCUMENTS 1,552,994 A * 9/1925 Lindeman ..... 222/341
3,609,790 A * 10/1971 Butch ..... 15/104.165
5,204,483 A * 4/1993 Tellechea ..... 42/95

* cited by examiner

*Primary Examiner*—Stephen M. Johnson
(74) *Attorney, Agent, or Firm*—Stephen D. Carver

(57) ABSTRACT

A universal gun cleaning kit includes a universal handle including a female threaded opening of a first select size. A plurality of elongate rods have different outer diameters. Each rod has opposite near and distal ends. The distal ends are adapted for selectively receiving a gun barrel cleaning element. A plurality of shafts are each rotatably connected to an associated one of the rods. The shafts include a male threaded end of the first select size or a second select size. An adaptor has a female threaded end of the second select size and a male threaded end of the first select size. The shafts of the first select size can be directly threaded into the universal handle and the shafts of the second select size can be threaded into the universal handle using the adaptor so that, in use, a select one of the rods is rotatable relative to the universal handle.

9 Claims, 2 Drawing Sheets

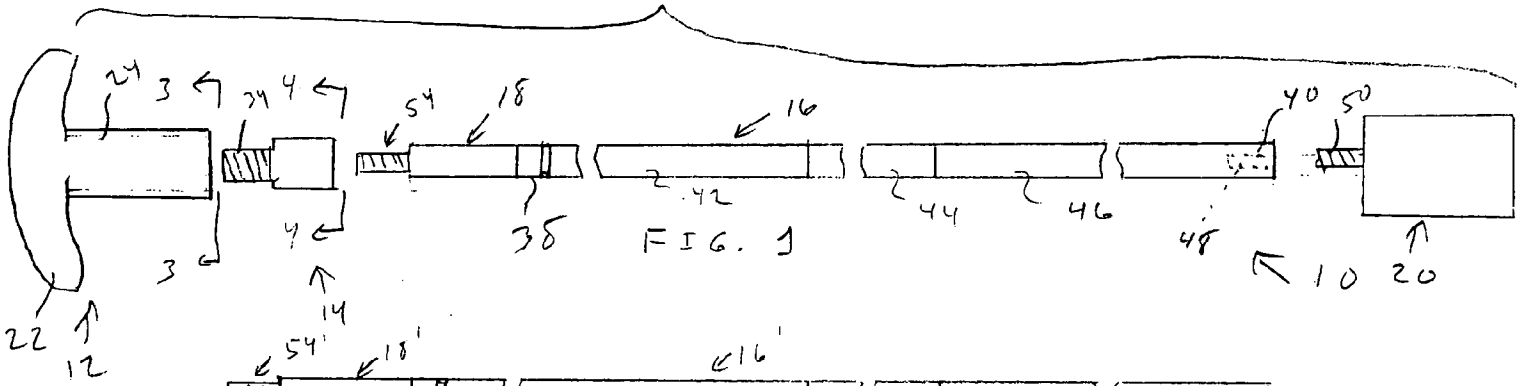
FIG. 1
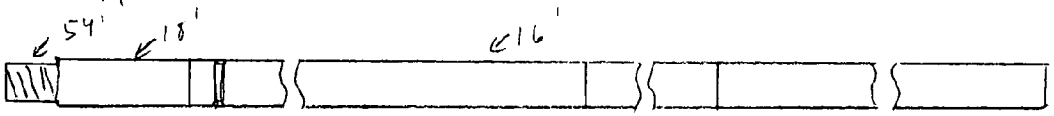
FIG. 2
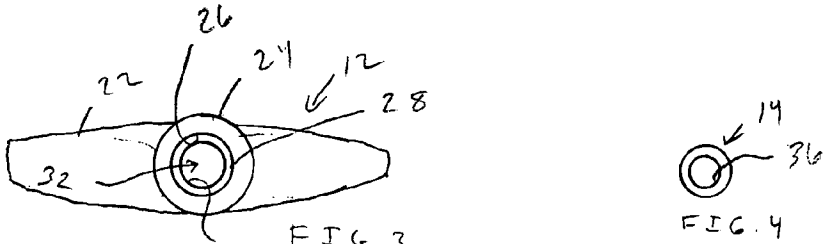
FIG. 3
FIG. 4
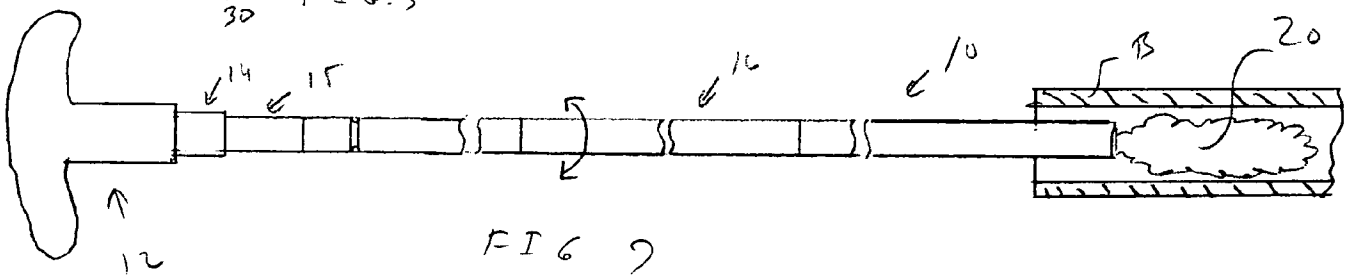
FIG. 5

GUN CLEANING KIT

FIELD OF THE INVENTION

This invention relates to a gun cleaning kit and, more particularly, to a gun cleaning kit including a universal handle and a rotatable rod.

BACKGROUND OF THE INVENTION

Gun cleaning kits are conventionally used for cleaning the barrel of a gun. A typical gun cleaning kit includes an elongate rod having a handle at one end and a gun barrel cleaning element at an opposite end. The rod is provided in plural sections which can be disassembled for storage. The handle is attached permanently to a top section of the rod. The top section of the rod is rotatable in the handle to prevent scratching inside the barrel and to prevent accessories such as a brush or mop from unscrewing and coming off inside the barrel of the gun.

Gun barrels are provided in numerous different sizes. Typical sizes are .17 cal. bore, .22 cal. bore, .30 cal. bore and shotgun. Separate gun cleaning kits, with the above-mentioned features, must be provided for each different size barrel. While different size rods could be provided, the handle being fixedly attached to the top section of rod requires that a different handle be provided for each rod set.

The present invention is directed to overcoming one or more of the problems discussed above in a novel and simple manner.

SUMMARY OF THE INVENTION

In accordance with the invention, there is provided a universal gun cleaning kit having a rod rotatably mounted to a handle.

Broadly, there is disclosed in accordance with one aspect of the invention a gun cleaning kit comprising a handle including a threaded opening. An elongate rod has opposite near and distal ends. The distal end is adapted for selectively receiving a gun barrel cleaning element. A shaft operatively connects the rod to the handle with a first end rotatably mounted to the rod near end and a second end being threaded into the threaded opening so that the rod is rotatable relative to the handle.

It is a feature of the invention that the handle comprises a counterbore and further comprises a metal receptacle fixedly mounted in the counterbore. The metal receptacle includes a threaded bore defining the threaded opening.

It is another feature of the invention that the shaft threaded end is of smaller diameter than the threaded opening and further comprising an adaptor threadably secured between the shaft and the handle.

It is another feature of the invention that the shaft includes an outwardly opening annular groove and the rod near end is telescopically received on the shaft and has an inwardly extending annular ridge received in the groove.

It is a further feature of the invention that the handle comprises a plastic handle and a metal receptacle is fixedly mounted in the handle. The metal receptacle includes a threaded bore defining the threaded opening.

It is still another feature of the feature that the rod is telescopically mounted to the shaft and further comprising a groove therebetween in at least one of the shaft and the rod and a bearing is received in the groove to rotatably mount the shaft to the rod.

It is yet another feature of the invention that the bearing is integrally formed in the other of the shaft and the rod.

There is disclosed in accordance with another aspect of the invention a universal gun cleaning kit including a universal handle including a female threaded opening of a first select size. A plurality of elongate rods have different outer diameters. Each rod has opposite near and distal ends. The distal ends are adapted for selectively receiving a gun barrel cleaning element. A plurality of shafts are each rotatably connected to an associated one of the rods. The shafts include a male threaded end of the first select size or a second select size. An adaptor has a female threaded end of the second select size and a male threaded end of the first select size. The shafts of the first select size can be directly threaded into the universal handle and the shafts of the second select size can be threaded into the universal handle using the adaptor so that, in use, a select one of the rods is rotatable relative to the universal handle.

Further features and advantages of the invention will be readily apparent from the specification and from the drawings.

BRIEF DESCRIPTION OF THE DRAWINGS

FIG. 1 is an exploded plan view of the universal gun cleaning kit in accordance with the invention;

FIG. 2 is a broken, plan view of an alternative elongate rod and shaft for use with the universal gun cleaning kit of FIG. 1;

FIG. 3 is an end view of a handle of the universal gun cleaning kit taken along a line 3—3 of FIG. 1;

FIG. 4 is an end view of an adaptor of the universal gun cleaning kit taken along the line 4—4 of FIG. 1;

FIG. 7 is a plan view of the universal gun cleaning kit in accordance with the invention in use for cleaning the barrel of a gun.

DETAILED DESCRIPTION OF THE INVENTION

Figure 6:
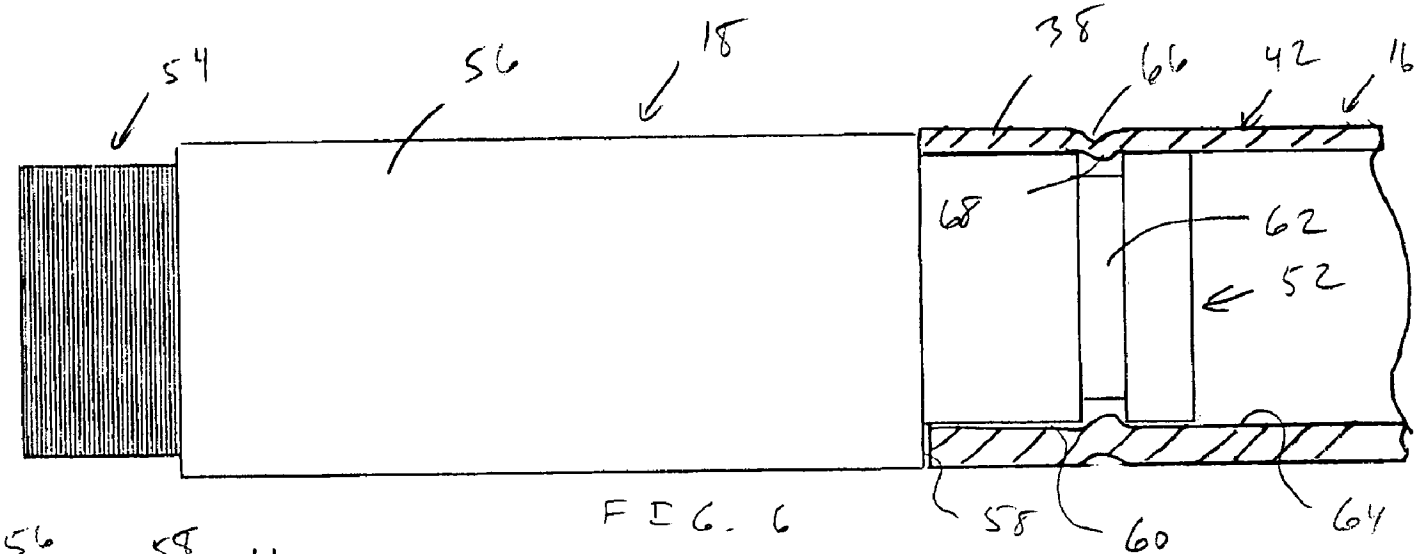
FIG. 6 is a partial plan view, similar to FIG. 5, with the rod shown in section.

The present invention relates to a universal gun cleaning kit including a universal handle for use with various size rods for cleaning, for example, .17 cal. bores, .22 cal. bores, .30 cal. bores and shotguns. The rods are attached to the handle to provide long term use of the kit and to provide rotation of the rod relative to the handle.

Referring initially to FIG. 1, a gun cleaning kit 10 according to one embodiment of the invention is illustrated. The gun cleaning kit 10 includes a handle 12, an adaptor 14, an elongate rod 16 and connected shaft 18, and a conventional gun cleaning element 20.

Referring also to FIG. 3, the handle 12 includes a head 22 for gripping by a user. In the illustrated embodiment of the invention, the head 22 is arcuate shaped. As is apparent, other shapes could be used for the head 22. A neck 24 extends from the head 22. The neck 24 is generally cylindrical and comprises an outwardly opening counterbore 26. A metal receptacle 28 is fixedly mounted in the counterbore 26. The metal receptacle includes a threaded bore 30 to define a threaded opening 32.

In the illustrated embodiment of the invention, the head 22 and neck 24 are integrally formed of one piece molded plastic. The receptacle 28 may be formed, for example, of brass molded in situ into the neck 24 or secured by friction fit or an adhesive. The use of a metal receptacle 28 minimizes stripping of the threads in the threaded opening 32. In accordance with the invention, the threaded opening 32 comprises a female threaded opening of a first select size. In an exemplary embodiment, the threaded opening 32 is 3/16 inch diameter.

Referring also to FIG. 4, the adaptor 14 is of metal construction, such as brass. The adaptor 14 includes a male threaded end 34 and an opposite female threaded opening 36. The male threaded end 34 is of a size to be threaded into the handle threaded opening 32. The female threaded opening 36 is of a second select size. In the exemplary embodiment of the invention, the female threaded opening 36 may be on the order of one quarter inch diameter.

The combination of the handle 12 and adaptor 14 provides a universal gun cleaning kit in which different size rods 16 can be used.

The rod 16 comprises an elongate metal rod having a near end 38 and opposite distal end 40. The rod 16 comprises a three piece rod having a first section 42 at the near end 38 threadably connected to a second, middle section 44, which is in turn connected to a third section 46 at the distal end 40. Each of the three sections 42, 44 and 46 are threadably connected to one another and provide a rod on the order of thirty-two inches long. As is apparent, the rod 16 could be a one piece rod of any known length. The use of three pieces provides for easier storage when the pieces 42, 44 and 46 are threadably separated. Also, depending on the length of the barrel to be cleaned, not all three pieces are required. The distal end 40 includes a female threaded opening 48 receiving a male threaded end 50 of the gun cleaning element 20. The gun cleaning element 20 may be, for example, a brush, mop, jag or slot tip. The present invention does not relate to any particular form of gun cleaning element 20.

Figure 5:
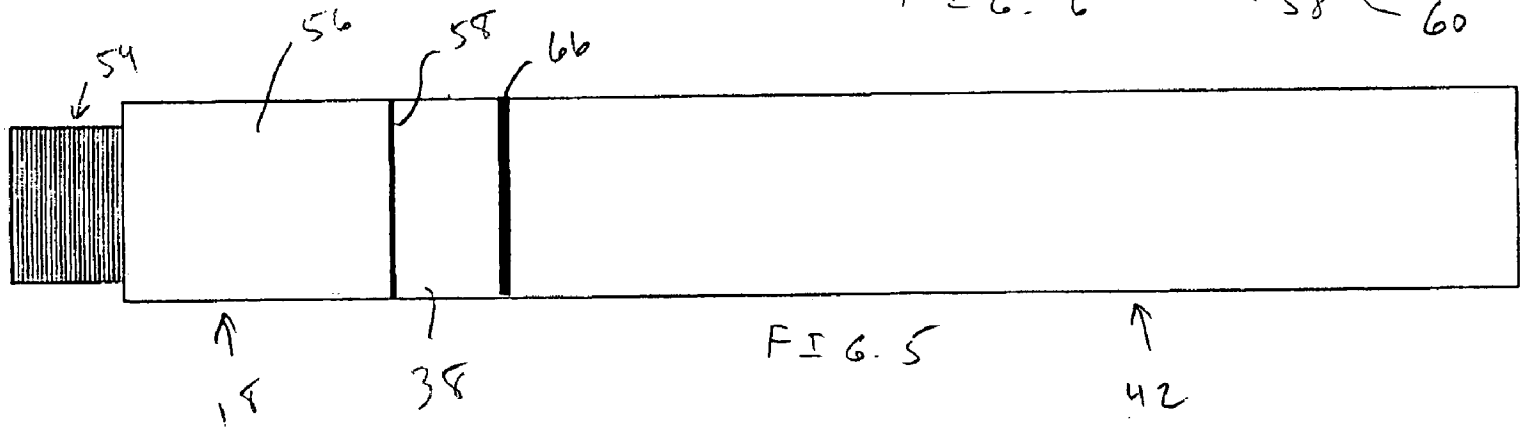
FIG. 5 is an enlarged plan view of a shaft and first section of the elongate rod of the universal gun cleaning kit of FIG. 1.

The shaft 18 is provided for rotatably connecting the rod 16 to the handle 12, directly or through the adaptor 14. Referring also to FIGS. 5 and 6, the shaft 18 includes a first end 52 rotatably mounted to the rod near end 38 and a second end 54 comprising a male threaded element. In the embodiment of FIG. 1, the male threaded element 54 is of the second select size to be threadably received in the female threaded opening 36 of the adaptor 14.

The shaft 18 is a machined part. In an exemplary embodiment of the invention, the shaft 18 is of brass construction having an outermost cylindrical diameter in a central portion 56 of about one half inch. The diameter is machined down starting at a shoulder 58 proximate the first end 52 to provide a neck 60. The neck 60 in the exemplary embodiment has an outer diameter of about 17/64 of an inch. An outwardly opening annular groove 62 in the neck has an outer diameter of about 15/64 of an inch. The neck 60 is telescopically received in a tapped out counterbore 64 at the near end 38 of the rod first section 42. A pressure groove 66 is formed in the outer wall of the rod first section 42 proximate the near end 38 creating an inwardly extending annular ridge 68 received in the groove 62, as is particularly shown in FIG. 6. Particularly, the ridge 68 functions as a bearing received in the groove 62 to rotatably mount the shaft 18 to the rod 16 with the rod near end 38 abutting the shoulder 58 to provide a generally seamless construction.

In the illustrated embodiment of the invention, the neck 60 extends from the shaft 18 and is received in the rod 16. As is apparent, this construction could be reversed so that the neck 60 extends from the rod 16 and is telescopically received in the shaft 18. Also, rather than use of a pressure groove, an inwardly opening annular groove could also be provided in the rod counterbore 64 and a locking bearing or ring could be received in both such grooves.

The assembled gun cleaning kit 10 is illustrated in FIG. 7 with the cleaning element 20 in the form of a brush received in a barrel B. As illustrated by the arrow, the rod 16 can freely rotate relative to the handle 20. This prevents the gun cleaning element 20 from unscrewing inside of the barrel B. Also, by providing the rotation effectively as part of the rod 16, using the shaft 18, the gun cleaning kit can be used with a universal handle, rather than providing an integral handle for each size rod.

Referring to FIG. 2, a rod 16' is illustrated. The rod 16' is generally similar to the rod 16 of FIG. 1, except that the shaft male threaded end 54' is of the first select size, such as, for example, 3/16 inch diameter. Likewise, the outer diameter of the rod 16' is greater than the diameter of the rod 16 of FIG. 1.

In accordance with the invention, a universal gun cleaning kit can be provided including a single universal handle 12 and adaptor 14. A plurality of different sets of rods, such as the rods 16 and 16', can be included for cleaning different gun sizes. The various size rods may be, for example, for cleaning .17 cal. bores, .22 cal. bores, .30 cal. bores, and shotguns. As will be apparent, rods for other size barrels can also be used, as necessary or desired. Thus, a plurality of different size rods can be used with a single universal handle with each rod being rotatably mounted to the handle 12, as described above.

I claim:

1. A universal gun cleaning kit comprising:

a universal handle including a female threaded opening of a first select size;

a plurality of elongate rods of different outer diameters, each rod having opposite near and distal ends, the distal ends being adapted for selectively receiving a gun barrel cleaning element;

a plurality of shafts each rotatably connected to an associated one of the rods, the shafts including a male threaded end of the first select size or a second select size; and an adaptor having a female threaded end of the second select size and a male threaded end of the first select size, wherein shafts of the first select size can be directly threaded into the universal handle and shafts of the second select size can be threaded into the universal handle using the adaptor so that, in use, a select one of the rods is rotatable relative to the universal handle.

2. The universal gun cleaning kit of claim 1 wherein the universal handle includes a head and a neck extending from the head, the neck including the female threaded opening.

3. The universal gun cleaning kit of claim 2 wherein the neck comprises a counterbore and further comprising a metal receptacle fixedly mounted in the counterbore, the metal receptacle including a threaded bore defining the female threaded opening.

4. The universal gun cleaning kit of claim 1 wherein each shaft includes an outwardly opening annular groove and the associated rod near end is telescopically received on the shaft and has an inwardly extending annular ridge received in the groove.

5. The universal gun cleaning kit of claim 1 wherein the handle comprises a plastic handle and a metal receptacle is fixedly mounted in the handle, the metal receptacle including a threaded bore defining the female threaded opening.

6. The universal gun cleaning kit of claim 1 wherein the plurality of rods are selected from a group including a .17 cal rod, a .22 cal rod, a .30 cal rod and a shotgun rod.

7. The universal gun cleaning kit of claim 1 wherein each rod comprises a three piece rod.

8. The universal gun cleaning kit of claim 1 wherein each shaft is telescopically mounted to the associated rod and further comprising a groove therebetween in at least one of the shaft and the associated rod and a bearing received in the groove to rotatably mount the shaft to the associated rod.

9. The gun cleaning kit of claim 8 wherein the bearing is integrally formed in the other of the shaft and the rod.

* * * * *